US010618086B2

(12) United States Patent
Stoneback et al.

(10) Patent No.: US 10,618,086 B2
(45) Date of Patent: Apr. 14, 2020

(54) DRAIN CLEANER WITH FEED HANDLE

(71) Applicant: Milwaukee Electric Tool Corporation, Brookfield, WI (US)

(72) Inventors: William D. Stoneback, Milwaukee, WI (US); Vasil Zhmendak, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 62 days.

(21) Appl. No.: 15/652,349

(22) Filed: Jul. 18, 2017

(65) Prior Publication Data

US 2018/0016776 A1 Jan. 18, 2018

Related U.S. Application Data

(60) Provisional application No. 62/363,708, filed on Jul. 18, 2016.

(51) Int. Cl.
*E03C 1/302* (2006.01)
*E03F 9/00* (2006.01)
*B08B 9/045* (2006.01)

(52) U.S. Cl.
CPC ..... *B08B 9/045* (2013.01); *E03C 1/302* (2013.01); *E03F 9/002* (2013.01)

(58) Field of Classification Search
CPC ..... B02C 2013/2816; B02C 6089/0535; F16G 3/006; E03F 9/002; E03C 1/302; B08B 9/0535; B08B 9/04; B08B 9/045
USPC ..... 15/104.33, 104.095
See application file for complete search history.

(56) References Cited

U.S. PATENT DOCUMENTS 3,206,782 A * 9/1965 Larsen ..... E03F 9/005 15/104.33
5,235,718 A * 8/1993 Grimsley ..... E03F 9/005 15/104.095
5,251,356 A * 10/1993 Oaki ..... A61B 1/122 15/104.095
5,636,403 A * 6/1997 Grimsley ..... B08B 9/045 15/104.095
5,987,684 A * 11/1999 Evans ..... E03F 9/005 15/104.31
9,592,890 B2 * 3/2017 Christensen ..... B63B 35/816
2004/0231723 A1 * 11/2004 Harrington ..... A01G 25/162 137/355.2
2005/0087644 A1 * 4/2005 Kim ..... B65H 75/425 242/390.8
2005/0193509 A1 * 9/2005 Rutkowski ..... B08B 9/045 15/104.33

(Continued)

*Primary Examiner* — Laura C Guidotti
*Assistant Examiner* — Thomas Raymond Rodgers
(74) *Attorney, Agent, or Firm* — Michael Best & Friedrich LLP

(57) ABSTRACT

A drain cleaner includes a base unit having a frame, a drum rotatably supported by the frame, a cable at least partially disposed within the drum, a motor supported by the frame for driving rotation of the drum and the cable, and a handle for guiding the cable into a drain. The handle includes a body, a passage formed in the body, and an actuator supported by the body. The passage receives a portion of the cable such that the handle is disposed around the cable and is movable along the cable relative to the base unit. The actuator is in communication with the motor for actuating rotation of the drum.

17 Claims, 8 Drawing Sheets

(56) References Cited

U.S. PATENT DOCUMENTS

| | | | | |
|---|---|---|---|---|
| 2006/0027155 | A1* | 2/2006 | Welch | B63B 35/816<br>114/254 |
| 2006/0249185 | A1* | 11/2006 | Garman | B08B 9/0433<br>134/166 R |
| 2007/0089254 | A1* | 4/2007 | Alaine | B08B 9/043<br>15/104.33 |
| 2009/0211044 | A1* | 8/2009 | Hale | B08B 9/045<br>15/104.33 |
| 2010/0125959 | A1* | 5/2010 | Sooy | B08B 9/04<br>15/104.33 |
| 2010/0139696 | A1* | 6/2010 | Silverman | B08B 9/045<br>134/22.11 |
| 2010/0294872 | A1* | 11/2010 | Wang | B65H 75/4407<br>242/390.8 |
| 2013/0105749 | A1* | 5/2013 | Gaillard | B66D 1/42<br>254/266 |

* cited by examiner

DRAIN CLEANER WITH FEED HANDLE

CROSS REFERENCE TO RELATED APPLICATIONS

This patent application claims priority from U.S. Provisional Patent Application Ser. No. 62/363,708, filed on Jul. 18, 2016, the entire contents of which are incorporated by reference herein.

BACKGROUND OF THE INVENTION

The present invention relates to drain cleaners, and specifically, to drain cleaners with a feed handle.

Drain cleaners are used to clean dirt and debris out of drains or other conduits that collect debris in locations that are difficult to access. Drain cleaners typically have a cable or snake that is inserted into the drain to collect the debris. Some drain cleaners have a frame that supports a drum and a motor for spinning the cable in the drum. Some cables are manually fed into the drain by a user pulling on the cable and feeding the cable into the drain by hand.

SUMMARY

In one embodiment, the invention provides a drain cleaner including a base unit having a frame, a drum rotatably supported by the frame, a cable at least partially disposed within the drum, and a motor supported by the frame for driving rotation of the drum and the cable. The drain cleaner also includes a handle for guiding the cable into a drain. The handle includes a body, a passage formed in the body, and an actuator supported by the body. The passage receives a portion of the cable such that the handle is disposed around the cable and is movable along the cable relative to the base unit. The actuator is in communication with the motor for actuating rotation of the drum.

In another embodiment, the invention provides a drain cleaner a base unit having a frame, a drum rotatably supported by the frame, a cable at least partially disposed within the drum, and a motor supported by the frame for driving rotation of the drum and the cable. The drain cleaner also includes a handle positioned around a portion of the cable for guiding the cable into a drain. The handle includes a body and an actuator supported by the body. The body has an open section through which a user can directly grasp the cable. The actuator is in communication with the motor for actuating rotation of the drum.

In another embodiment, the invention provides a drain cleaner including a base unit having a frame, a drum rotatably supported by the frame, a cable at least partially disposed within the drum, and a motor supported by the frame for driving rotation of the drum and the cable. The drain cleaner also includes a handle positioned around a portion of the cable for guiding the cable into a drain. The handle includes a body, an actuator supported by the body, and a first wireless communication device supported by the body and coupled to the actuator. The drain cleaner further includes a second wireless communication device coupled to the motor. The second wireless communication device is operable to receive a signal from the first wireless communication device in response to actuation of the actuator to energize the motor and rotate the drum.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
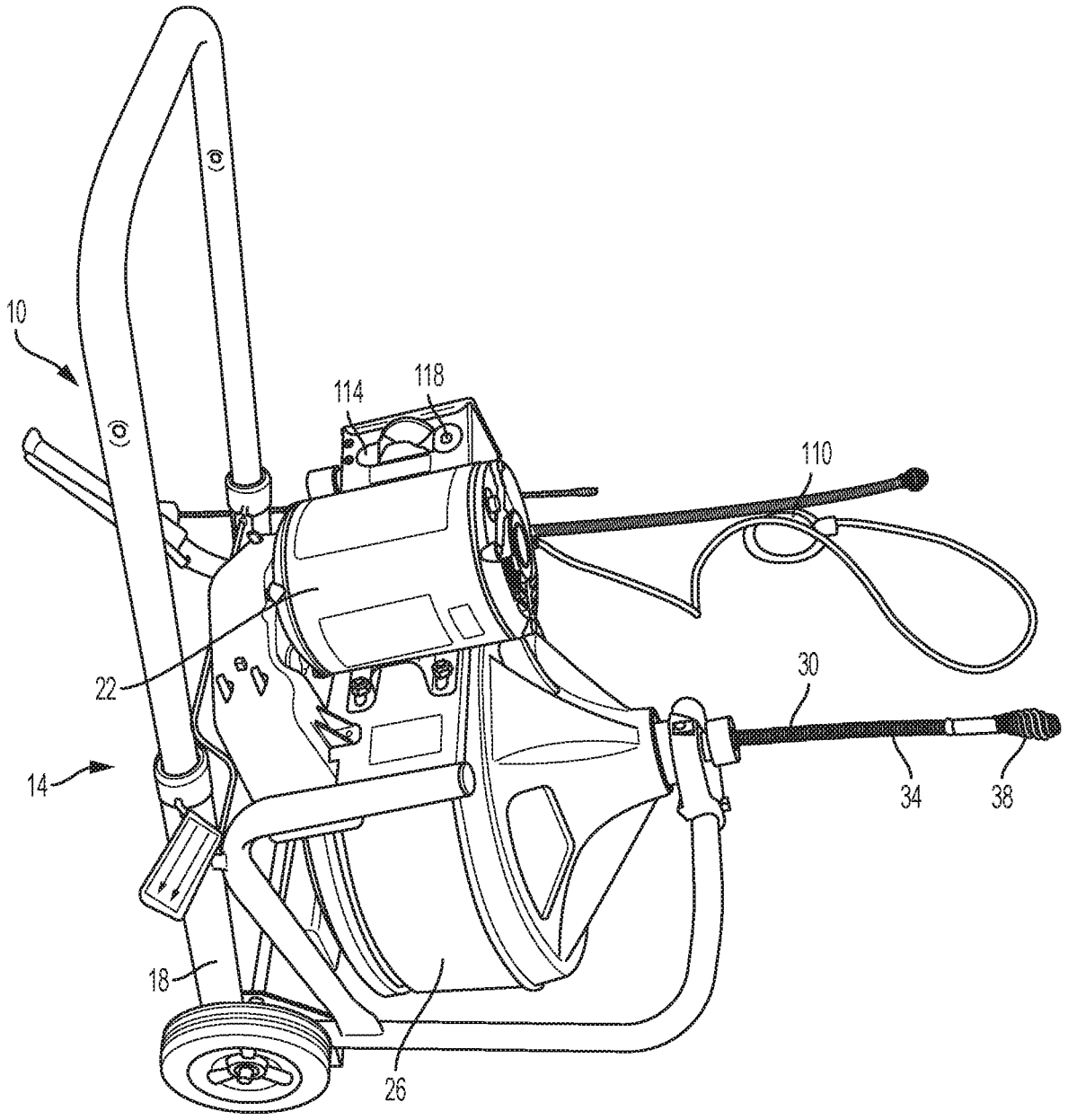
FIG. 1 is a perspective view of a drain cleaner.

FIG. 1 illustrates a drain cleaner 10 according to one embodiment. The illustrated drain cleaner 10 is a free standing drain cleaner 10. The drain cleaner 10 includes a base unit 14 having a frame 18, a motor 22, a drum 26, and a cable 30. The motor 22 and the drum 26 are supported by the frame 18. The cable 30 is at least partially housed in the drum 26, with a leading end 34 of the cable 30 extending outside of the drum 26. The drum 26 is rotatably supported by the frame 18 such that the drum 26 can rotate relative to the frame 18. In the illustrated embodiment, rotation of the drum 26 is driven by the motor 22, and rotation of the drum 26 causes the cable 30 to rotate. In addition to rotating, the cable 30 can also be displaced in an axial direction so that the cable 30 can be fed into the drain. Specifically, the leading end 34 of the cable 30 is fed into a drain to unclog the drain and remove debris. In the illustrated embodiment, the leading end 34 is manually guided into a drain by a user pulling the cable 30 out of the drum 26 and feeding the cable 30 into the drain. The leading end 34 of the cable 30 may include an auger head 38 or other tool attachment to help unclog the drain.

Figure 2:
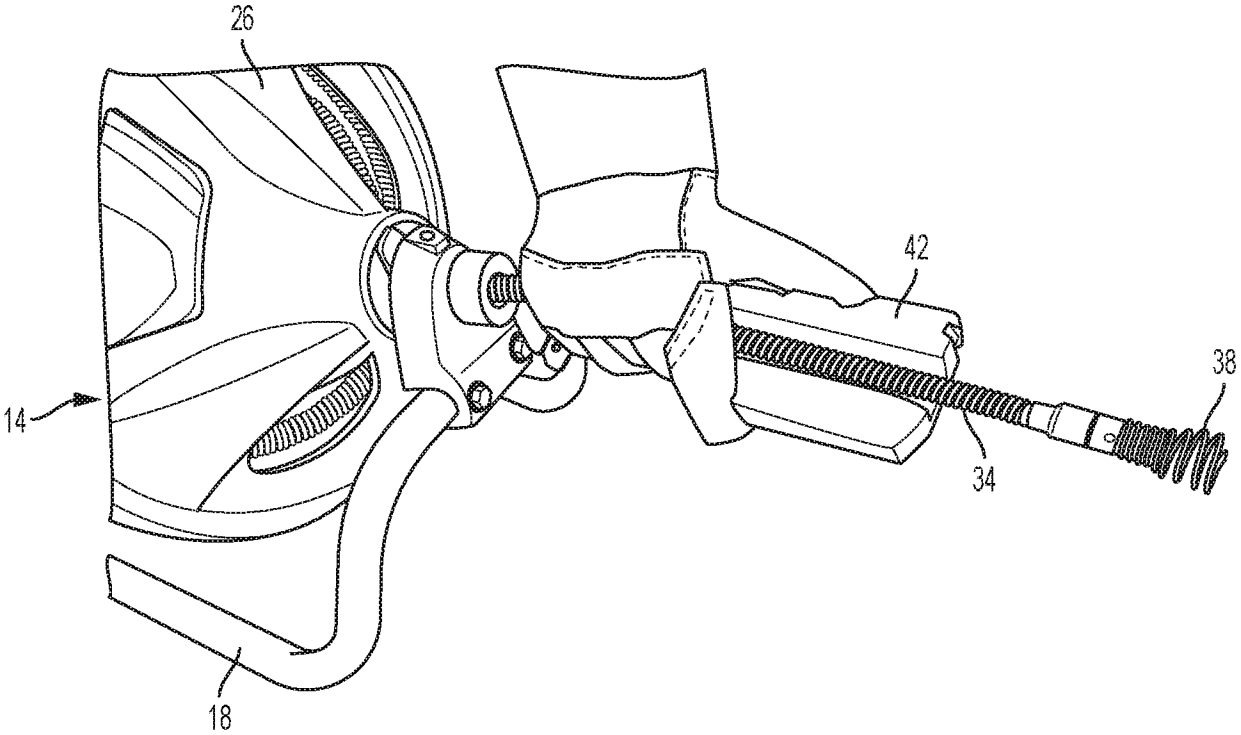
FIG. 2 is a perspective view of a portion of the drain cleaner of FIG. 1 including a feed handle in a first position.
Figure 3:
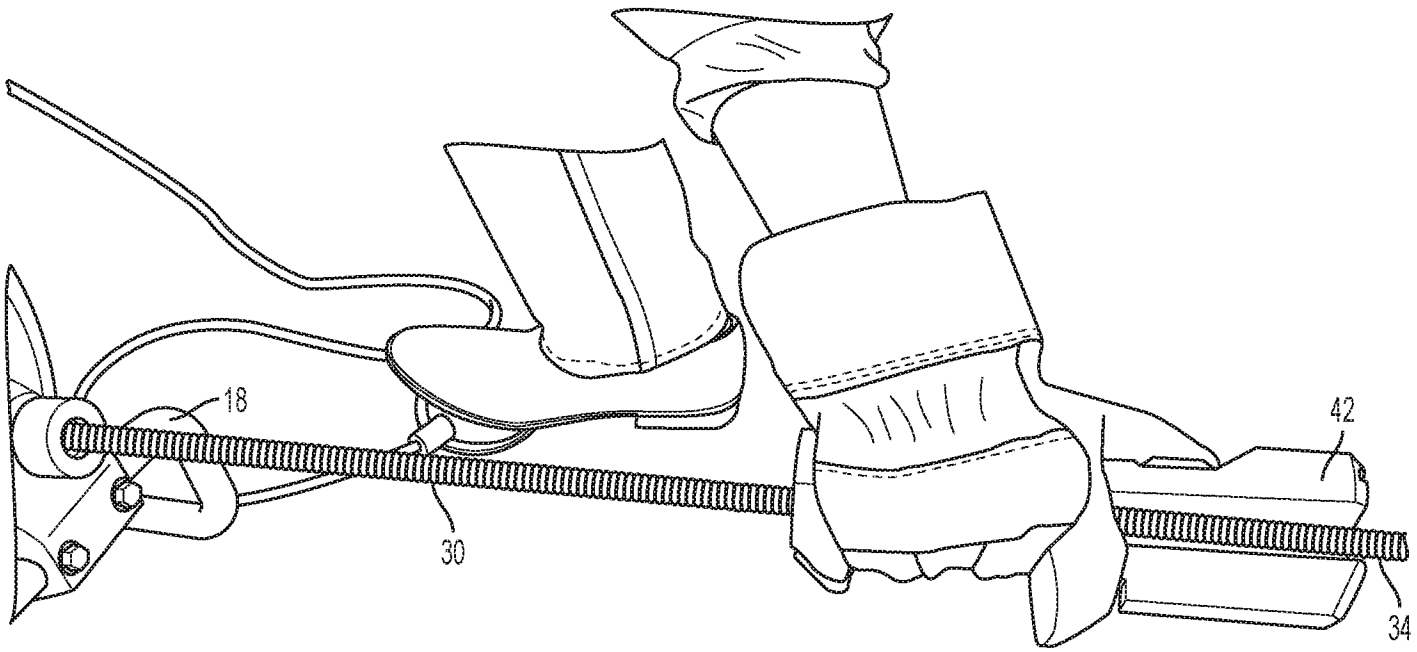
FIG. 3 is a perspective view of a portion of the drain cleaner of FIG. 1 including the feed handle in a second position.
Figure 4:
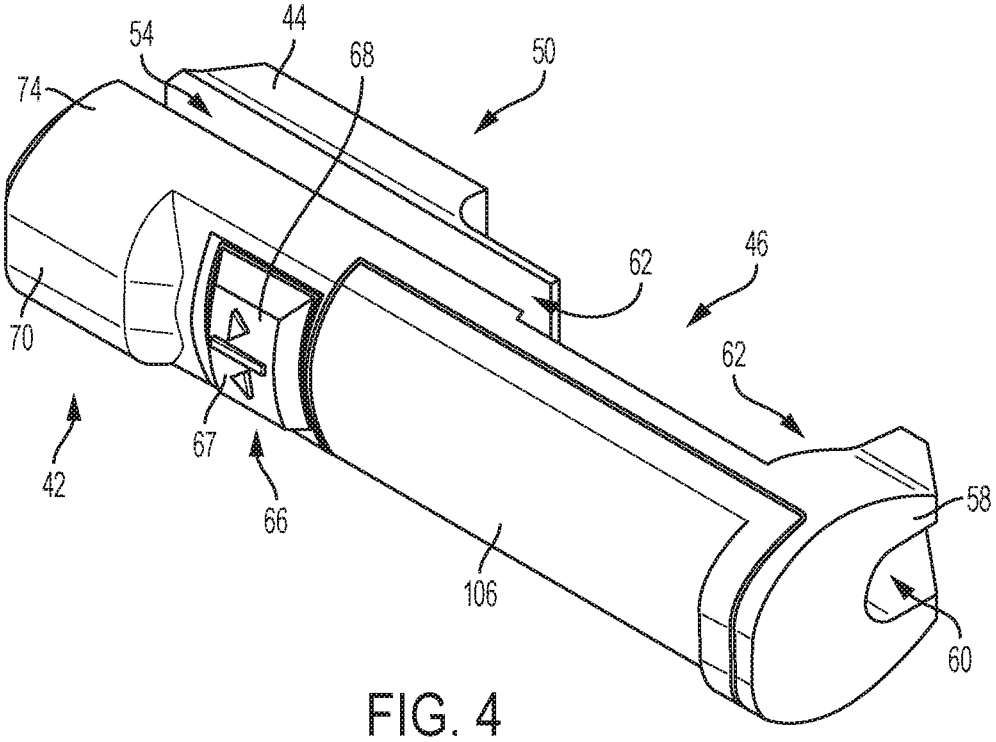
FIG. 4 is a perspective view of the feed handle.
Figure 5:
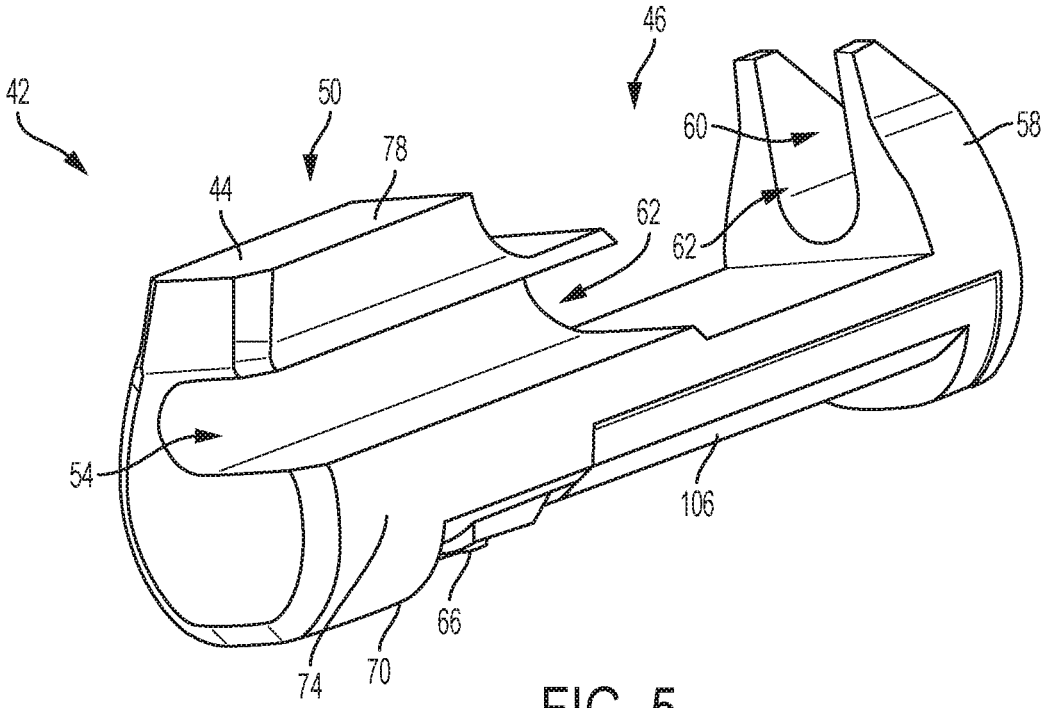
FIG. 5 is another perspective view of the feed handle of FIG. 4.
Figure 6:
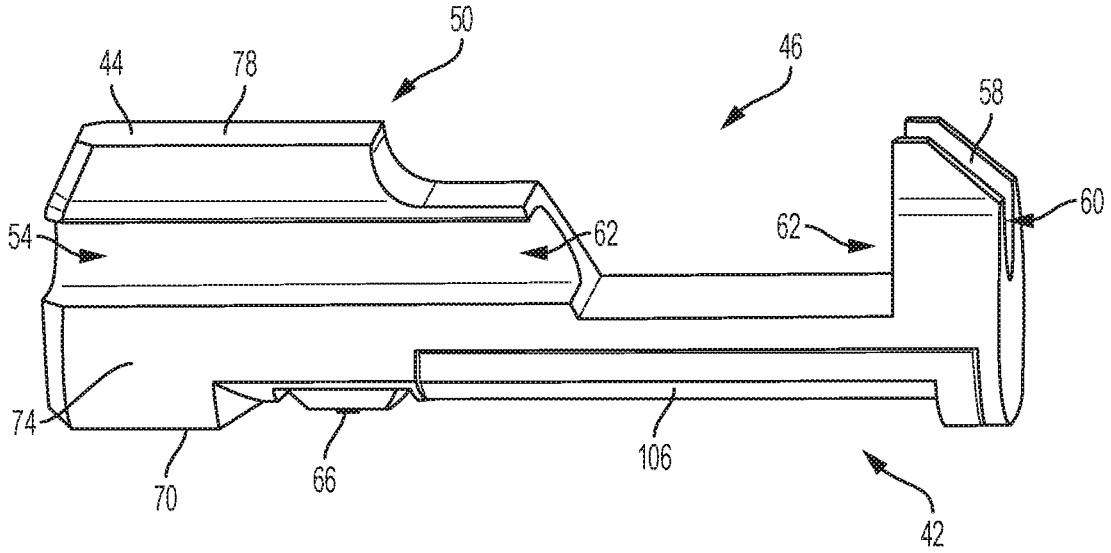
FIG. 6 is a first side view of the feed handle of FIG. 4.
Figure 7:
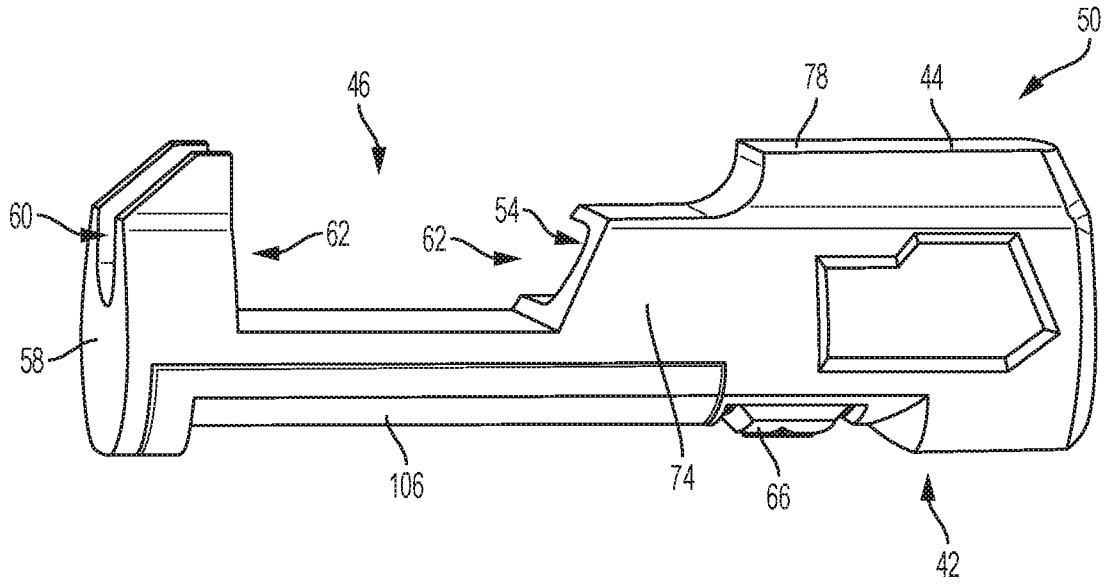
FIG. 7 is a second side view of the feed handle of FIG. 4.
Figure 8:
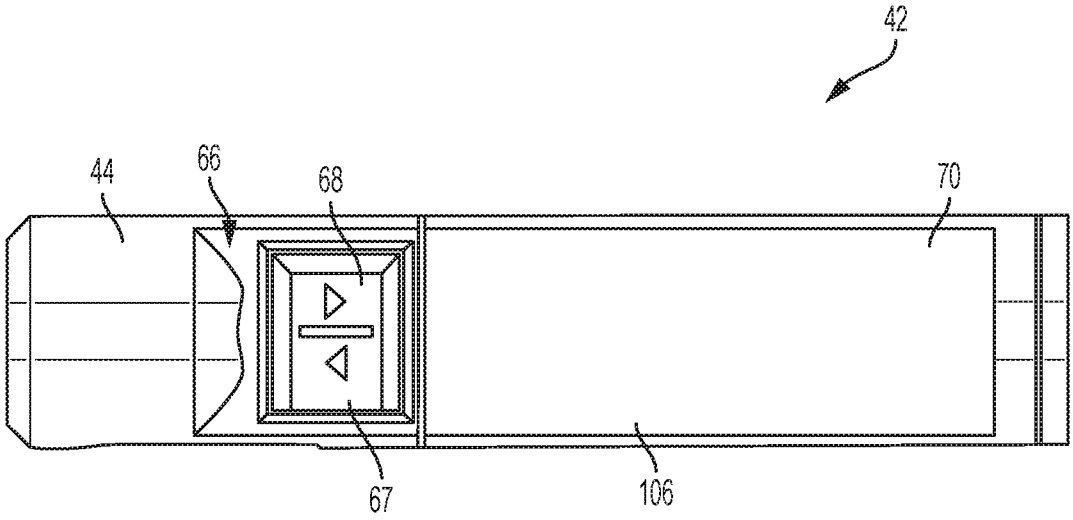
FIG. 8 is a bottom view of the feed handle of FIG. 4.
Figure 9:
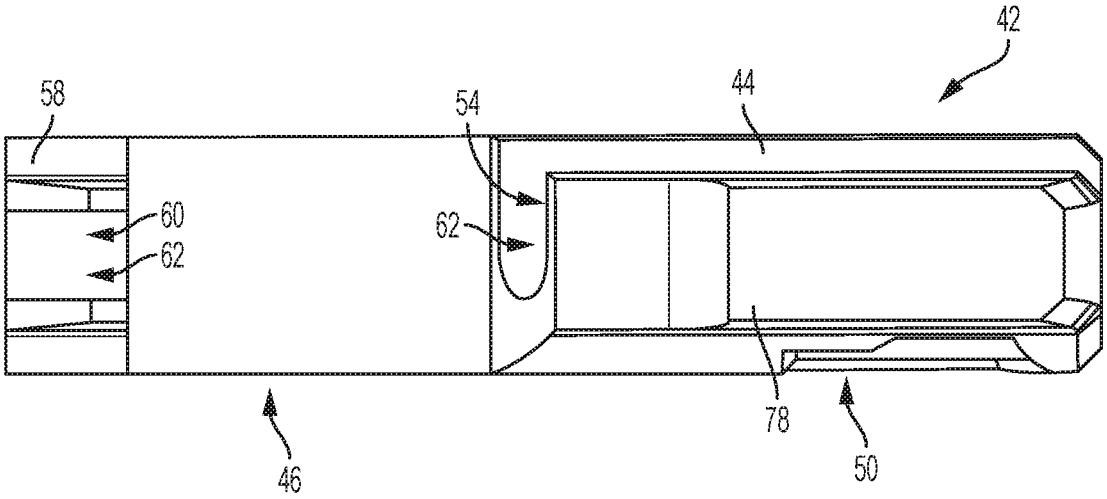
FIG. 9 is a top view of the feed handle of FIG. 4.
Figure 11:
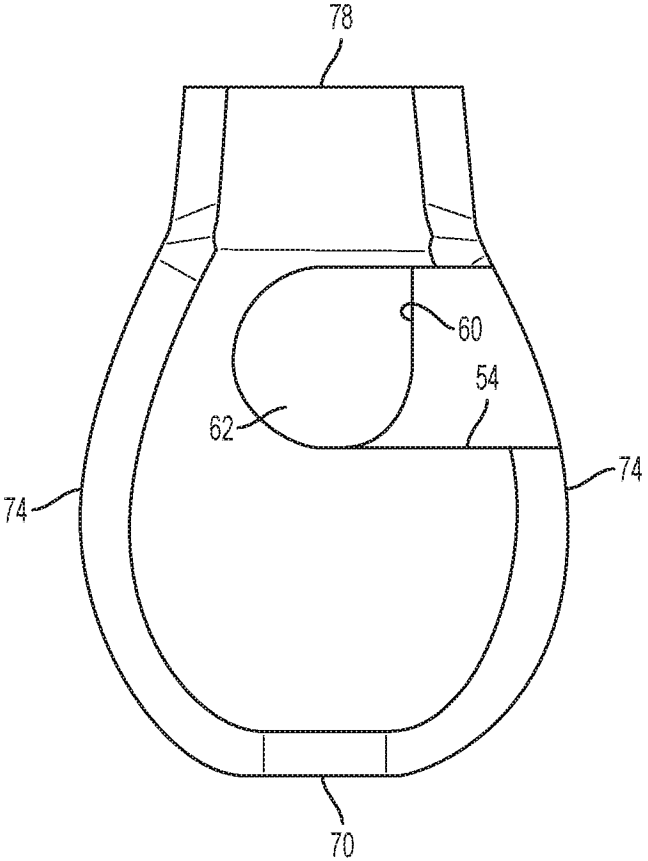
FIG. 11 is a second end view of the feed handle of FIG. 4.
Figure 10:
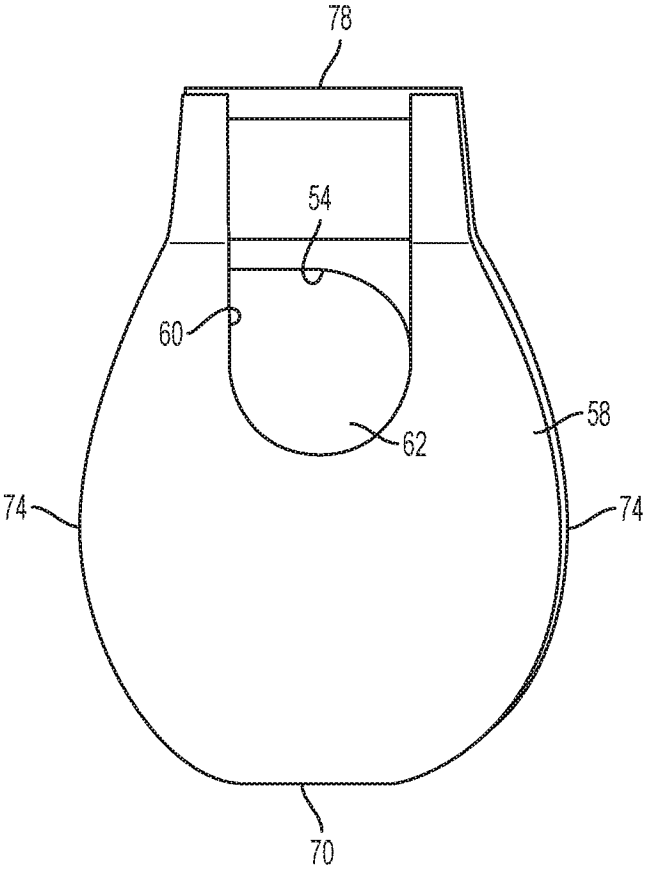
FIG. 10 is a first end view of the feed handle of FIG. 4.

As shown in FIGS. 2 and 3, the illustrated drain cleaner 10 is provided with a handle 42 disposed on the cable 30. In some embodiments, the handle 42 assists in rotating the cable 30 as well as guiding the cable 30 into the drain. Referring to FIGS. 4-11, the handle 42 has an elongated body 44 having an open section 46 and a partially closed section 50. The partially closed section 50 includes a channel 54 that leads to the open section 46. The open section 46 includes a U-shaped prong 58 with a through hole 60 that aligns with the channel 54. The handle 42 provides a passage 62 for the cable 30 to pass through. Specifically, the handle 42 engages with the cable 30 such that the cable 30 extends through the channel 54, across the open section 46, and through the hole 60 in the prong 58. A portion of the cable 30 is exposed within the channel 54 and the open section 46 to enable the user to pull or push the cable 30 into or out of the drain while grasping the handle 42.

The handle 42 further includes an actuator 66 for starting and stopping rotation of the cable 30. Pressing on the actuator 66 will actuate the motor 22 to start rotating the drum 26 and the cable 30. Releasing the actuator 66 will stop rotation of the drum 26 and the cable 30. In the illustrated embodiment, the actuator 66 includes a first button 67 that when pressed rotates the drum 26 a first direction (e.g., clockwise) and a second button 68 that when pressed rotates the drum a second direction opposite the first direction (e.g., counter-clockwise) In the illustrated embodiment, the actuator 66 is disposed on the partially closed section 50 of the handle 42 along a bottom surface 70 of the handle 42. In other embodiments, the actuator 66 is disposed on a side surface 74 or a top surface 78 of the handle 42. The configuration of the handle 42 allows the user to control the rotation of the cable 30 while also pulling the cable 30 in an axial direction to feed the cable 30 into the drain. Specifically, the user may grasp the cable 30 with the same hand that engages the actuator 66 for controlling the cable 30 rotation. Additionally, the user may grasp the open section 46 of the handle 42 with a second hand to allow for two-handed extension and retraction of the cable 30.

The handle 42 is moveable relative to the cable such that the cable 30 can slide through the passage 62 as the cable 30 is fed into the drain. In other words, the handle 42 can be positioned proximate the leading end 34 of the cable 30 when the cable 30 is retracted within the drum 22. The cable 30 can also slide through the passage 62 relative to the handle 42 as the leading end 34 is extended into the drain. The handle 42 is also movable with the cable 30 and with respect to the base unit 14. As shown in FIGS. 2 and 3, the handle 42 can move from a first position proximate the base unit 14 of the drain cleaner 10 (FIG. 2) to a second position away from the base unit 14 of the drain cleaner 10 (FIG. 3). Accordingly, the handle 42 allows for control of the motor 22 from a position that is remote from the base unit 14.

Figure 12:
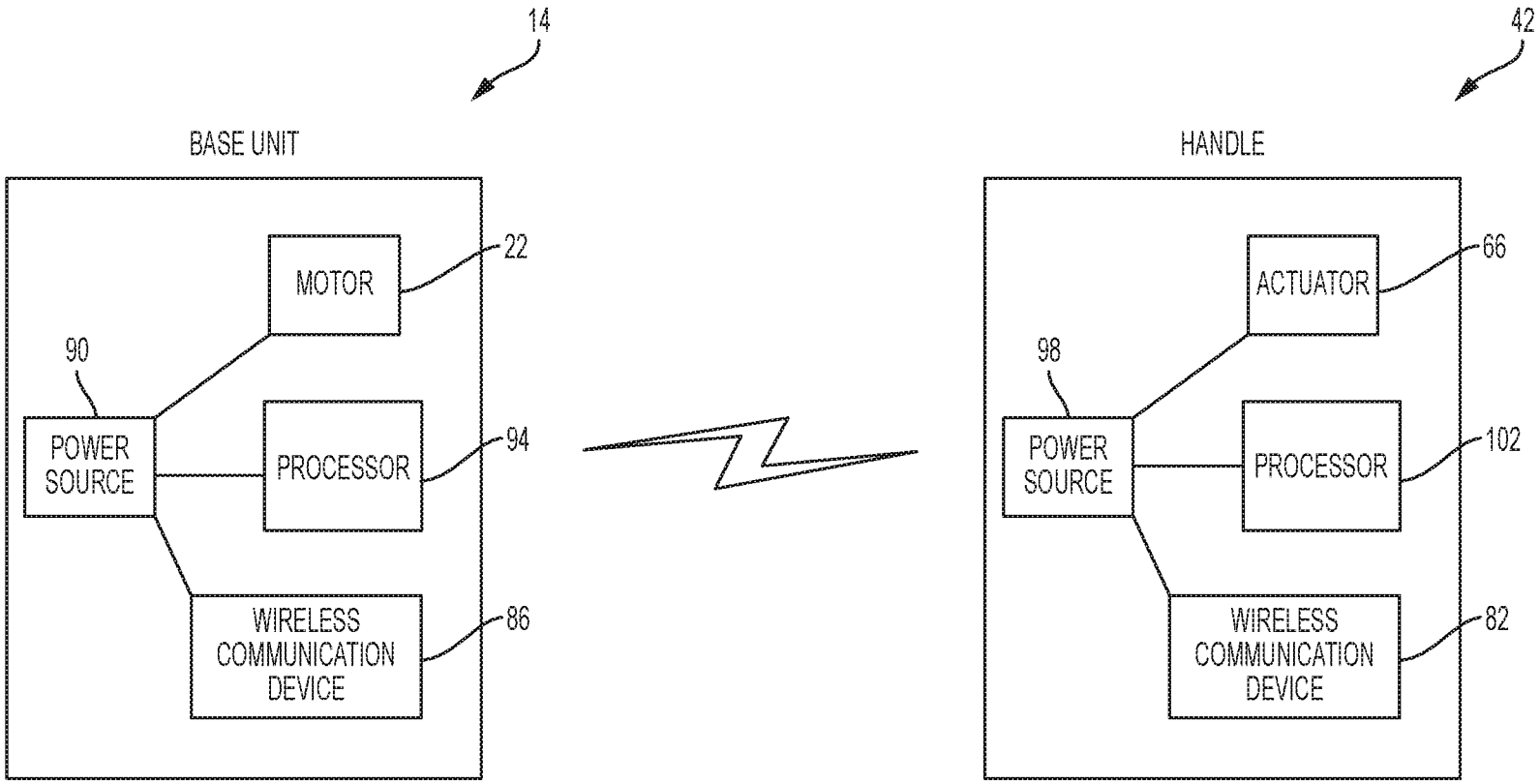
FIG. 12 is a schematic diagram of a base unit of the drain cleaner and the feed handle.

With reference to FIG. 12, in some embodiments, the handle 42 communicates wirelessly with the motor 22 so that a wire or cord is not necessary when the handle 42 is in a position that is remote from the base unit 14. The handle 42 can communicate with the motor 22 via any known wireless communication, such as radio or optical transceivers, Bluetooth, WiFi, etc. As such, the handle 42 may support a first wireless communication device 82. Accordingly, the drain cleaner 10 may include a second wireless communication device 86 on the base unit 14 for receiving a signal from the first wireless communication device 82. In addition, the drain cleaner 10 may also include an indicator to indicate that the handle 42 is paired or in communication with the motor 22. For example, the drain cleaner 10 may include an LED light on one or both of the base unit 14 or the handle 42. The LED light may flash or light up when the handle 42 is wirelessly paired with the motor 22.

With continued reference to FIG. 12, a first power source 90 is supported on the base unit 14. The first power source 90 is electrically coupled to the motor 22, a first processor 94, and the second wireless communication device 86. The first power source 90 may be a battery pack, such as a rechargeable power tool battery pack. Alternatively, the first power source 90 may include circuitry for receiving power from an external AC power source.

The handle 42 includes a second power source 98 supported by the body 44 to provide power to the first wireless communication device 82, a second processor 102, and the actuator 66. The second power source 98 may be, for example, one or more batteries. In the illustrated embodiment, the handle 42 may include a battery receptacle 106 for receiving the batteries to power the handle 42. In some embodiments, the handle 42 may be hardwired to the base unit 14 to communicate with the motor 22 and/or for receiving AC power.

In operation, when a user presses the actuator 66 on the handle 42, the first wireless communication device 82 sends a signal to the second communication device 86. The signal is interpreted by the first processor 94, and the first processor 94 instructs the motor 22 to actuate. If the first button 67 is pressed, the processor 94 instructs the motor 22 to rotate in a first direction. Alternatively, if the second button 68 is pressed, the processor 94 instructs the motor 22 to rotate in a second direction that is opposite the first direction.

In some embodiments, the motor 22 can be actuated by other actuators. For example, the motor 22 is actuated by a foot pedal 110. Stepping down on the foot pedal 110 actuates the motor 22 to start rotating the drum 26, and thus, rotating the cable 30. When a user releases the pedal 110, the motor 22 will stop rotating the drum 26 and the cable 30 will stop spinning within the drain. The foot pedal 110 is located proximate to or remotely from the base unit 14. In some embodiments, the drain cleaner 10 includes a switch 114 located on the base unit 14 for actuating the motor 22. The drain cleaner 10 can include any combination of actuators including the handle 42, the foot pedal 110, and the switch 114 for actuating the motor 22. When the drain cleaner 10 includes more than one actuator, the drain cleaner 10 may further include a control switch 118 to changed modes of operation between the different actuators. For example, the control switch 118 is set to allow one of the actuators (e.g., the handle 42) to actuate the motor 22, while deactivating the other actuators (e.g., the foot pedal 110 and the switch 114 on the base unit 14).

Additionally, in one embodiment, the drain cleaner 10 includes a braking mechanism that will actively stop the spinning of the cable 30 when the user discontinues pressing the actuator 66 to cause the cable 30 to stop spinning. In other words, rather than simply deactivating the motor 22 and allowing the drum 26 and cable 30 to stop spinning, the braking mechanism can actively slow down rotation of the drum 26 and the cable 30. The braking mechanism can include a mechanical brake, electrical motor 22 braking, or any other type of known braking mechanism.

Various features and advantages of the invention are set forth in the following claims.

What is claimed is:

1. A drain cleaner comprising:

a base unit having a frame;

a drum rotatably supported by the frame;

a cable at least partially disposed within the drum;

a motor supported by the frame for driving rotation of the drum and the cable; and a handle for guiding the cable into a drain, the handle including a body having an open section and a partially closed section, the partially closed section defining a channel that leads into the open section, the channel and the open section receiving a portion of the cable such that the handle is disposed around the cable and is movable along the cable relative to the base unit during operation of the motor, the handle also including an actuator supported by the body, the actuator being in communication with the motor for actuating rotation of the drum;

wherein the cable is accessible to a user through the open section, and wherein the cable is covered by the body of the handle in the partially closed section; and wherein the open section of the handle allows a user to grasp the cable so that movement of the handle relative to the base unit pulls the cable out of or pushes the cable into the drain.

2. The drain cleaner of claim 1, wherein the handle includes a first wireless communication device supported by the body and coupled to the actuator, and the drain cleaner further comprising a second wireless communication device coupled to the motor, wherein the second wireless communication device receives a signal from the first wireless communication device to actuate the motor.

3. The drain cleaner of claim 2, wherein the actuator is operable to send the signal to actuate the motor.

4. The drain cleaner of claim 2, wherein the handle further includes a power source supported by the body and coupled to the first wireless communication device.

5. The drain cleaner of claim 1, wherein the actuator is supported on the body adjacent the partially closed section.

6. The drain cleaner of claim 1, wherein the actuator includes a first button operable to actuate the motor to rotate in a first direction.

7. The drain cleaner of claim 6, wherein the actuator includes a second button operable to actuate the motor to rotate in a second direction opposite the first direction.

8. The drain cleaner of claim 1, further comprising a foot pedal coupled to the base unit in communication with the motor for actuating rotation of the motor.

9. The drain cleaner of claim 8, further comprising a switch supported on the base unit to control actuating the motor between the actuator and the foot pedal.

10. A drain cleaner comprising:

a base unit having a frame;

a drum rotatably supported by the frame;

a cable at least partially disposed within the drum;

a motor supported by the frame for driving rotation of the drum and the cable; and a handle positioned around a portion of the cable for guiding the cable into a drain, the handle including a body and an actuator supported by the body, the body having an open section through which a user can directly grasp the cable, the actuator being in communication with the motor for actuating rotation of the drum;

wherein the handle is held stationary relative to the cable by the user grasping the cable through the open section, and wherein the handle is movable along the cable when the user disengages the cable through the open section; and wherein the handle is moveable relative to the base unit between a first positon proximate the base unit and a second position away from the base unit to extend the cable further into the drain.

11. The drain cleaner of claim 10, wherein the handle includes a first wireless communication device supported by the body and coupled to the actuator, and the drain cleaner further comprising a second wireless communication device coupled to the motor, wherein the second wireless communication device receives a signal from the first wireless communication device to actuate the motor.

12. A drain cleaner comprising:

a base unit having a frame;

a drum rotatably supported by the frame;

a cable at least partially disposed within the drum;

a motor supported by the frame for driving rotation of the drum and the cable; and a handle positioned around a portion of the cable for guiding the cable into a drain, the handle including a body, an actuator supported by the body, and a first wireless communication device supported by the body and coupled to the actuator; and a second wireless communication device coupled to the motor, the second wireless communication device operable to receive a signal from the first wireless communication device in response to actuation of the actuator to energize the motor and rotate the drum;

wherein the handle is moveable relative to the base unit between a first position proximate the base unit and a second position away from the base unit to extend the cable further in to the drain.

13. The drain cleaner of claim 12, wherein the handle includes a power source supported by the body to power the handle independently of the motor.

14. The drain cleaner of claim 13, wherein the power source is electrically coupled to the actuator and the first wireless communication device.

15. The drain cleaner of claim 12, further comprising a foot pedal coupled to the base unit in communication with the motor for actuating the motor.

16. The drain cleaner of claim 1, wherein the handle is remote from the base unit.

17. The drain cleaner of claim 1, wherein the handle is operable to actuate the motor and rotate the drum when the handle is not disposed around the cable.

* * * * *